US005778347A

United States Patent [19]

Hetzer

[11] Patent Number: 5,778,347

[45] Date of Patent: Jul. 7, 1998

[54] ARRANGEMENT FOR AN ELECTRONIC POSTAGE METER MACHINE

[75] Inventor: Ulrich Hetzer, Berlin, Germany

[73] Assignee: Francotyp-Postalia AG & Co., Birkenwerder, Germany

[21] Appl. No.: 662,151

[22] Filed: Jun. 12, 1996

[30] Foreign Application Priority Data

Jun. 19, 1995 [DE] Germany ..... 195 22 600.3

[51] Int. Cl.[6] ..... B41J 2/165; B41J 2/01; G07B 17/00

[52] U.S. Cl. ..... 705/408; 101/71; 101/425; 347/1; 347/22; 347/29

[58] Field of Search ..... 101/71, 425; 347/1, 347/2, 22, 29, 33; 364/464.18; 705/408

[56] References Cited

U.S. PATENT DOCUMENTS

| | | | |
|---|---|---|---|
| 4,123,761 | 10/1978 | Kimura et al. | 346/140 R |
| 4,168,533 | 9/1979 | Schwartz | 364/DIG. 2 |
| 4,300,145 | 11/1981 | van Raamsdonk | 346/470 R |
| 4,412,232 | 10/1983 | Weber et al. | 346/140 R |
| 4,500,894 | 2/1985 | Kiner | 347/29 |
| 4,543,589 | 9/1985 | Terasawa | 346/140 R |
| 4,739,340 | 4/1988 | Terasawa | 346/1.1 |
| 4,903,232 | 2/1990 | O'Connell et al. | 364/DIG. 2 |
| 5,051,758 | 9/1991 | Markham | 347/28 |
| 5,182,582 | 1/1993 | Okamura | 346/140 R |
| 5,189,442 | 2/1993 | Herbert | 347/2 |
| 5,365,044 | 11/1994 | Hesshaus | 235/375 |
| 5,396,271 | 3/1995 | Premnath | 347/33 |
| 5,467,709 | 11/1995 | Salomon | 101/93 |
| 5,517,218 | 5/1996 | Lehna et al. | 347/24 |
| 5,565,898 | 10/1996 | Sakuma | 347/23 |
| 5,592,034 | 1/1997 | Felmus et al. | 307/130 |
| 5,608,432 | 3/1997 | Yamaguchi | 347/33 |

FOREIGN PATENT DOCUMENTS

| | | |
|---|---|---|
| 0 036 295 | 9/1981 | European Pat. Off. . |
| 29 14 986 | 10/1979 | Germany . |
| 1 566 342 | 4/1980 | United Kingdom . |

*Primary Examiner*—Edward R. Cosimano
*Attorney, Agent, or Firm*—Hill & Simpson

[57] ABSTRACT

Arrangement for an electronic manual franking machine having an ink printer head and an integrated system for controlling and supplying the ink printer head includes a housing containing a first assembly, which includes a carriage, an ink printer head with a replaceable ink tank and a cleaning part with a sealing cap, and a second assembly which includes at least one data input and control electronics as well as a rechargeable battery with a charging connection. The carriage operates such that the recording medium is maintained taut in the printing region. The cleaning ensues by ink ejection and/or extraction into the sealing cap, by sucking the sealing cap empty and wiping the ink printer head. Specifically fashioned extraction channels enable a shortened cleaning procedure.

33 Claims, 11 Drawing Sheets

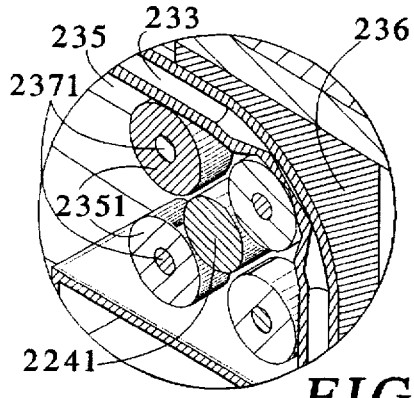
FIG. 6B
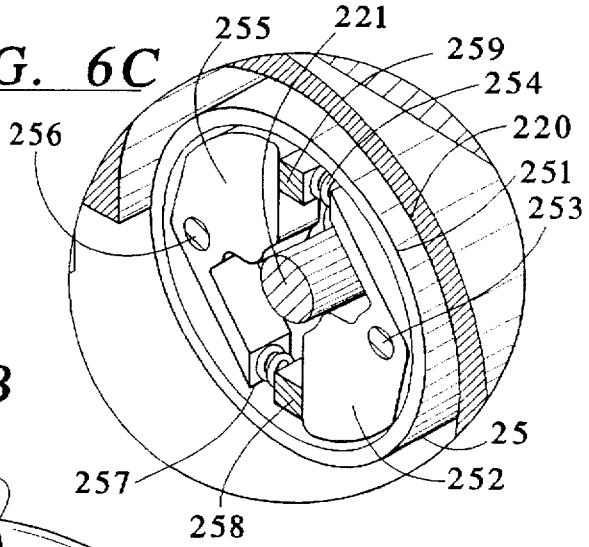
FIG. 6C
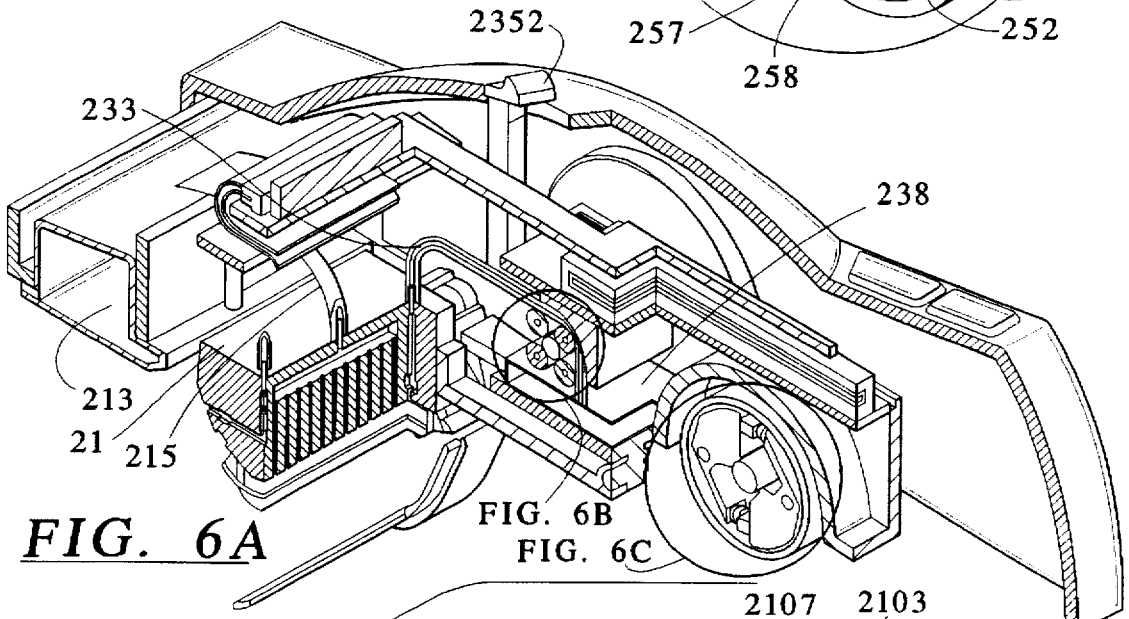
FIG. 6A
FIG. 6D
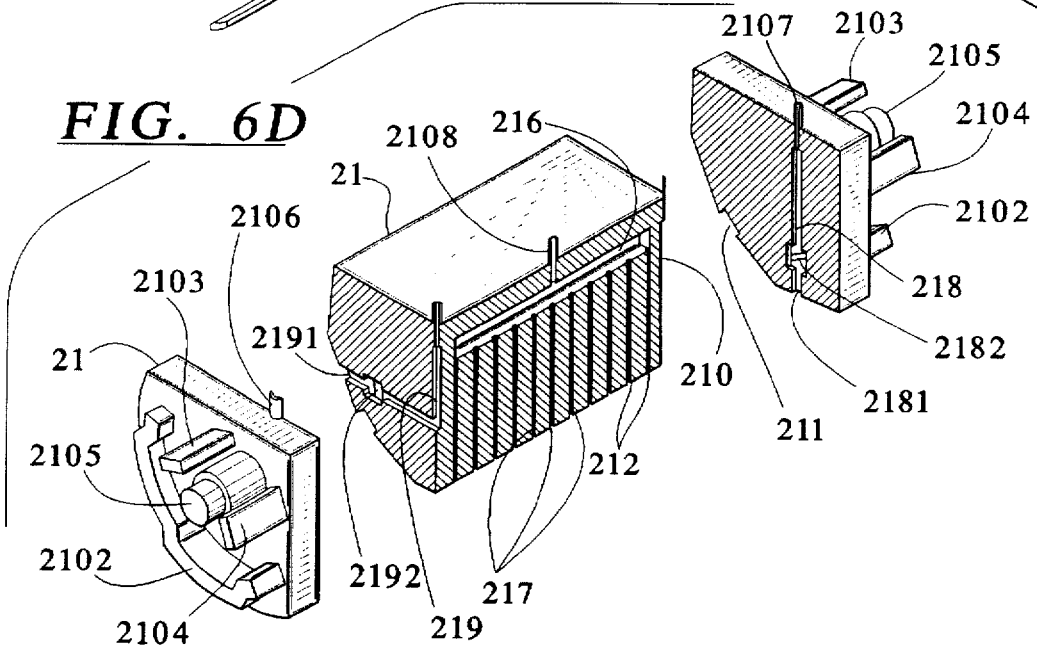

ARRANGEMENT FOR AN ELECTRONIC POSTAGE METER MACHINE

BACKGROUND OF THE INVENTION

1. Related Application

The subject matter of the present application is related to the subject matter disclosed in an application filed simultaneously herewith, assigned to the same Assignee (Francotyp Postalia AG & Co.) entitled "Electronic Manual Postage Meter Machine Having A Recharging and Cleaning Adapter." Hetzer et al. (Ser. No. 08/66,956).

2. Field of the Invention

The invention is directed to an arrangement for an electronic manual postage meter machine (hand franking machine) with an ink-jet print head and with integrated means for controlling and supplying the ink-jet print head.

DESCRIPTION OF THE PRIOR ART

Postage meter machines of the above type can be employed everywhere where there is only low mail volume but there is a desire for a modern franking imprint.

The mechanical predecessor of such a postage meter machine is the D2 postage meter machine of Francotyp-Postalia that has been in use for many decades. This postage meter machine works without chip cards, so that the user must undertake a payment of fees at the post office, where a postal clerk directly sets the crediting system in the machine and seals it with a lead seal, as described in the instruction manual.

On the other hand, a franking tape generator system is known, as described in PCT Application WO 92/07338, with which a date a postage value and an advertizing slogan are printed on a franking tape. A printer unit, a processor system, a read-write means, an operating device and a tape supply container are arranged in a common housing. The write-read means serves the purpose of accepting postage credit cards and is connected to the processor system via information lines for the exchange of digitized data for identification, fee debiting and the individual advertizing slogan stored on the postage credit card. The digitized data of the advertizing slogan as well as monitoring and security data are likewise transmitted between the processor system and the printer unit via information and signal lines. The system can be operated independently of a network with batteries or rechargeable accumulators. For this system, the batteries must supply the energy for the printer unit as well as for the drive of the tape roll; accordingly, the batteries must be high-power batteries because the operating time would otherwise be limited. The tape supply container requires a corresponding volume. A loading of the postage meter machines at the post office is eliminated by employing postage credit cards, however, the franking tapes must be glued onto the postal matter and must be of such a nature that a re-use or further use is precluded.

A franker for printing a value imprint postal matter with an ink-jet printer means is also known, see German OS 27 01 072. The pattern of the postage value imprint is composed of successive sub-patterns. The franker contains an electronic control means for the ink-jet printer means and the control sequence thereof, a clock circuit for clocking the logic circuit during the course of printing as well as a postage fee memory. The franker is provided with a microcomputer operating on the basis of its own power supply whose clock circuit is actuated by a detector means. The detector means serves the purpose of identifying the relative speed of the franker with respect to the postal matter and supplying this information to the clock circuit as control signals. The clock circuit generates clock signals for the logic circuit of the microcomputer proportional to the relative speed. The ink-jet printer means successively emits the respective sub-patterns of the postage value imprint in the clock of these clock signals when the franker is moved over the postal matter. Two parallel axles each having two guide rollers at the ends serve to facilitate the motion. Eleven nozzles are arranged in the ink jet printer means in a row transverse relative to the moving direction of the franker.

The detector means is constructed as an optical monitor. A light source in the form of a light-emitting diode is focussed onto the region of the recording medium into which the ink drops are ejected from the ink jet printer means. The reflected light is supplied to a phototransistor via an optical probe composed of fibers. The microcomputer is programmed such that an ink drop is ejected every time the printer means is actuated. In order to permit a continuous optical scanning, a control pattern in the form of a line of printed dots is generated in addition to the actual franking imprint, the former underlining the latter. The monitor senses this line. The phototransistor reacts to changes from printing dot to free (unprinted) region in this control line and generates a pulsating signal that is forwarded to the microcomputer, the frequency of this pulsating signal thus being determined by the speed with which the monitor moves over the control line.

A rechargeable nickel-cadmium battery serves as the power supply.

Except for the nozzle discharge area, the housing of this known franker is closed with a cap that is displaceable corresponding to the stroke of an actuation switch but that can only be removed by an authorized person. This ensues in a postage distribution center when the stored postage has been largely used. The franker contains a number of input connections that are all accessible when the cap is removed. These input connections are composed of two sockets that are connected to the microcomputer, two sockets from the input of the power supply for the purpose of connection to a charging source, and a refill means for the ink reservoir.

After removal of the cap, the franker is plugged into a central location that has a main input plug that is connected to a charging means for the power supply, to an ink supply and a postage output computer. In one procedure, thus, the battery is recharged, additionally purchased postage is entered into the memory register of the microcomputer and the ink reservoir is filled.

It is obvious that the postage distribution center must usually be visited in order to recharge the battery, rather than for replenishing postage credit. If the hand franker is to meet moderns demands—printing not only a value imprint but an advertizing slogan as well—, then an ink printer head having 192 nozzles is required. Such an ink print head has a corresponding high energy consumption for setting the required operating temperature and for ink ejection which, if employed in a hand franker, would drain the battery long before the usual time for replenishing postage. Moreover, such ink print heads require an adapted cleaning mechanism that is entirely lacking in a hand franker. Since the nozzle area is always open, there is the risk during pauses in operation that the ink in the nozzle will dry and plug the nozzles. When the hand franker is mover over the postal matter on four parallel wheels running in the same direction, there is the risk that convexity and slippage arise in the recording medium and the print quality thus suffers. Determining the relative speed with bright-dark differences on the recording medium is susceptible to disruption dependent on the color of the recording medium, more so given a dark medium, less so given a light medium.

It has already been proposed in general for ink jet printers to attach an extraction means for cleaning the ink printer head to the latter itself, see German OS 27 25 761.

It has likewise been proposed for ink printers with a moving ink printer head that the nozzle discharge area be able to be covered in every position thereof, see German 29 19 727. To this end, a seal means that has a cover pad is moved together with the ink printer head on the basis of a mount. The seal means is displaceable from the outside in a position that makes the nozzle discharge area tight or releases it, this displacement occurring via a rocker extending over the entire range of motion of the ink printer head and via a coupling part placed against the mount. The nozzle area has a salient, all-around collar; the seal means is lowered thereinto. A cavity which is filled with ink by capillary action from the nozzles is formed in this way. This arrangement is specifically adapted to office printers, is relatively complex and the cleaning effect is achieved only with the cover cushion pad.

For intensifying the absorbency of an ink-absorbing means within a cap, another solution—see German OS 32 37 411 —bring a suction line to the back side of the inkabsorbing means, an external suction pump being connected to the other end thereof. The ink stored in the absorbing means is eliminated in this way at the same time.

Finally, a ink jet recording device having at least one ink printer head and a regeneration means is also known from German OS 37 36 916.

In this device, a carriage with the ink printer heads is moved from a recording region into a regeneration and cleaning region. During the motion, the nozzle surface sweeps past an elastic wiper lip and is roughly cleaned in this way. A regeneration means having a cover housing is mounted against the ink printer head in the regeneration region, whereby each nozzle row, or each ink printer module given multi-color heads, is separately covered. The regeneration means operates with a suction pump. Ink, ink residues and air bubbles are suctioned off by under-pressure. This solution is also specifically tailored to an office printer.

SUMMARY OF THE INVENTION

A goal of the invention is to increase the dependability and the field of employment of manual franking machines having ink printer heads.

An object of the present invention is to provide a solution for a manual franking machine that meets modern demands for postage and slogan printing and for which a regeneration—reloading postage, recharging the battery and refilling ink—in a central means such as the post office is eliminated. In particular, an internal cleaning possibility should be present for the ink printer head and the latter should also be protected against drying out during pauses in use.

The above object is achieved in accordance with the principles of the present invention in an electronic manual franking machine having an ink printer head and an integrated system for controlling and supplying the ink printer head, the ink printer head being part of a first assembly which is contained in a housing, the first assembly also including a carriage and a replaceable ink tank and a cleaning part with a sealing cap. The electronic manual franking machine also includes a second assembly contained in the housing, the second assembly including at least one data input and control electronics and a rechargeable battery. The carriage operates so that the recording medium is maintained taut in the printing region, and cleaning ensues by ink ejection and/or extraction into the sealing cap, the sealing cap being emptied by suction and the ink being wiped from the printer head. The apparatus can include ink extraction channels which enable a shortened cleaning procedure.

The manual franking machine according to the inventive arrangement is protected against data manipulations by operation with a data input means such as a postage credit card; and additional sealing is also possible. European Application 0 566 225 describes further possibilities for data input into a postage meter machine, which therefore need not be discussed further herein. Due to the inventive combination of an ink printer head with a replaceable ink tank, a cleaning part and a sealing cap as well as a rechargeable battery with a charging terminal, the user has on site capability to keep the manual franking machine always ready to operate.

In printers and postage meter machines that are implemented as a console unit, relatively great outlay is incurred in order to achieve a defined transport and a defined position of the recording medium relative to the ink printer head. Except for the matching between printing speed and moving speed, such goals seem unachievable at first sight for a manual franking machine. Keeping the recording medium taut in all directions within the printing region is achieved for the first time with the inventive fashioning of the carriage and the drive as well as the design and positioning of the wheels.

Fastening the ink printer head to a lever that is resiliently seated in a region between two detents and glides on the recording medium with a spacer nose constantly assures a constant spacing between the nozzle apertures and the recording medium.

Given adherence to the emplacement mark, a presmoothing of the recording medium and a reliable mechanical contact between the two is achieved by the uses of only one drum-shaped front wheel is provided. The travel rate can thus be acquired with adequate precision by the incremental sensor connected to the front wheel.

A centrifugal brake is provided which prevents the maximally allowed travel speed from being exceeded.

The housing of the manual franking machine is resiliently seated on the carriage and is also ergonomically designed so that flexible operation is possible.

Cleaning of the ink printer head ensues via ink ejection through the write nozzles and/or extraction of ink into the sealing cap in the adapter, whereby the ink is simultaneously extracted from the sealing cap into an extraction tank with a suction pump for manual operation. The suction pump may, for example, be a peristaltic pump. The cleaning procedure can be limited to the shortest necessary time since the sealing cap—swivelled away from the ink printer head—is freed of ink residues during printing operation via a further extraction channel. A further suction pump (which also may be a peristaltic pump), that is connected to the drive shaft of the coupling wheel, is provided for this purpose.

The manual as well as the automatic pump obtains the required drive energy from the user; the batteries are thus substantially relieved and can be dimensioned smaller. Since the cleaning part directly adjoins the ink printer head, dimensions that are required for covering the nozzle area suffice for the sealing cap. The valves in the extraction channels prevent residual ink from running out and from drying.

The two peristaltic suction pumps can be eliminated in an embodiment of the cleaning part with only one micro-structure suction pump integrated therein and wherein the outer extraction channels are joined orthogonally relative to one another to form a common extraction channel.

A wiper lip serves for rough cleaning of the nozzle surface in a known way. A resilient suspension of the sealing cap with the allocated lever for the swivel thereof at the housing of the ink printer head always secures a defined position between ink printer head and sealing cap and adequate tightness. A good detent in the limit position is achieved by the combination of guide pins with depressions at the housing of the ink printer head and catch noses at the sealing cap.

This arrangement—in modified form—is also very advantageously suited as a product labeling or industrial labeling device. Instead of the postage credit card with debiting of the postage value, a corresponding chip card with product data and a piece count can be utilized.

DESCRIPTION OF THE DRAWINGS

FIG. 6A is a perspective view of for the assembly surrounding ink printer head. FIG. 6B is an enlarged detail from FIG. 6A showing; the peristaltic suction pump for manual operation FIG. 6C is an enlarged detail from FIG. 6A showing the centrifugal brake, and FIG. 6D is an enlarged, exploded veiw showing details of the ink printer head, in the manual franking machine constructed in accordance with the principles of the present invention.

DESCRIPTION OF THE PREFERRED EMBODIMENTS

For simplifying the illustration and for an improved understanding, the drawings are partly schematic.

Figure 1:
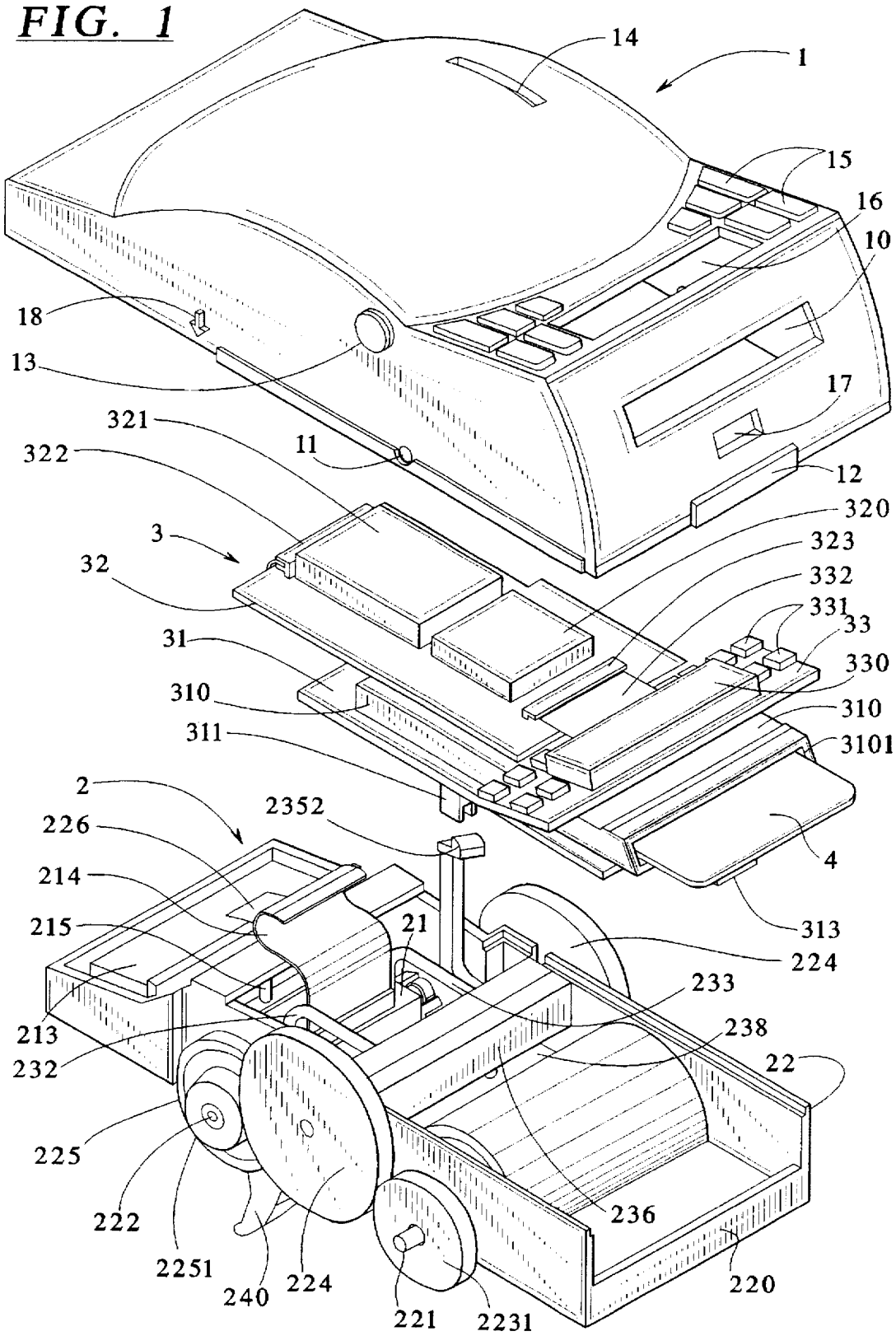
FIG. 1 is an exploded view of an electronic manual franking machine constructed in accordance with the principles of the present invention.

As shown in FIG. 1, an electronic manual franking machine has a housing 1, a first assembly 2 and a second assembly 3. The second assembly 3 is put in place onto the first assembly and the two are arranged together in the housing 1.

The housing 1 is designed so as to be ergonomically adapted for manual use. The housing 1 includes a slot 10 for the introduction of a postage credit card 4, i.e., a card of a known type having paid-for postage, and possibly other information, stored thereon. The housing 1 also has openings 11 for a front axle 221, an operating knob 13 for unlocking a sealing cap 230, or for producing operational readiness, and an opening 14 for an operating lever 2352 of a suction pump, such as a peristaltic suction pump 235, for manual operation.

The housing 1 has a number of operating keys 15 and an opening 16 for receiving the visible portion of a display 330. The housing 1 has an opening 17 for a charging connection, a front and back guide mark 12, and a placement mark 18 for franking.

A first assembly 2 is contained in the housing 1. The first assembly 2 includes an ink printer head 21 with an ink tank 213 and an extraction tank 238 connected thereto by respective connecting hoses 215, 232 and 233. The first assembly 2 also includes a carriage 22 having a carriage frame 220, the aforementioned front axle 221 with two drive wheels 2231, and two coupling wheels 224, and two rear axles 222 each having a rear wheel 225 and a driven wheel 2251. The first assembly 2 also includes a pump housing 236 for the aforementioned peristaltic suction pump 235 and a further peristaltic suction pump 234, with the aforementioned operating lever 2352 for the peristaltic suction pump 235 for manual operation thereof.

The housing 1 is resiliently seated on the carriage 22 by means of a spring 226.

The housing 1 also contains a second assembly 3. The second assembly 3 includes a first circuit board 31 with a write-read unit 310 and a postage credit card receptacle 3101 in registry with the slot 10 in the housing 1. The first circuit board 31 also carries a sensor 311 for acquiring the speed of movement of the machine, and a charging connection 313 for an external charging means.

The second assembly 3 also includes a second circuit board 32 carrying a microprocessor 320 and a rechargeable battery 321, as well as a third circuit board carrying the aforementioned display 330 and switching elements 331.

The ink print head 21 is connected via a connecting cable 214 to the second circuit board 32 that is provided with a plug-type connector 322 for this purpose.

The third circuit board 33 is connected via a connecting cable 332 to the second circuit board 32 that is provided with another plug-type connector 323 for this purpose.

Figure 2A:
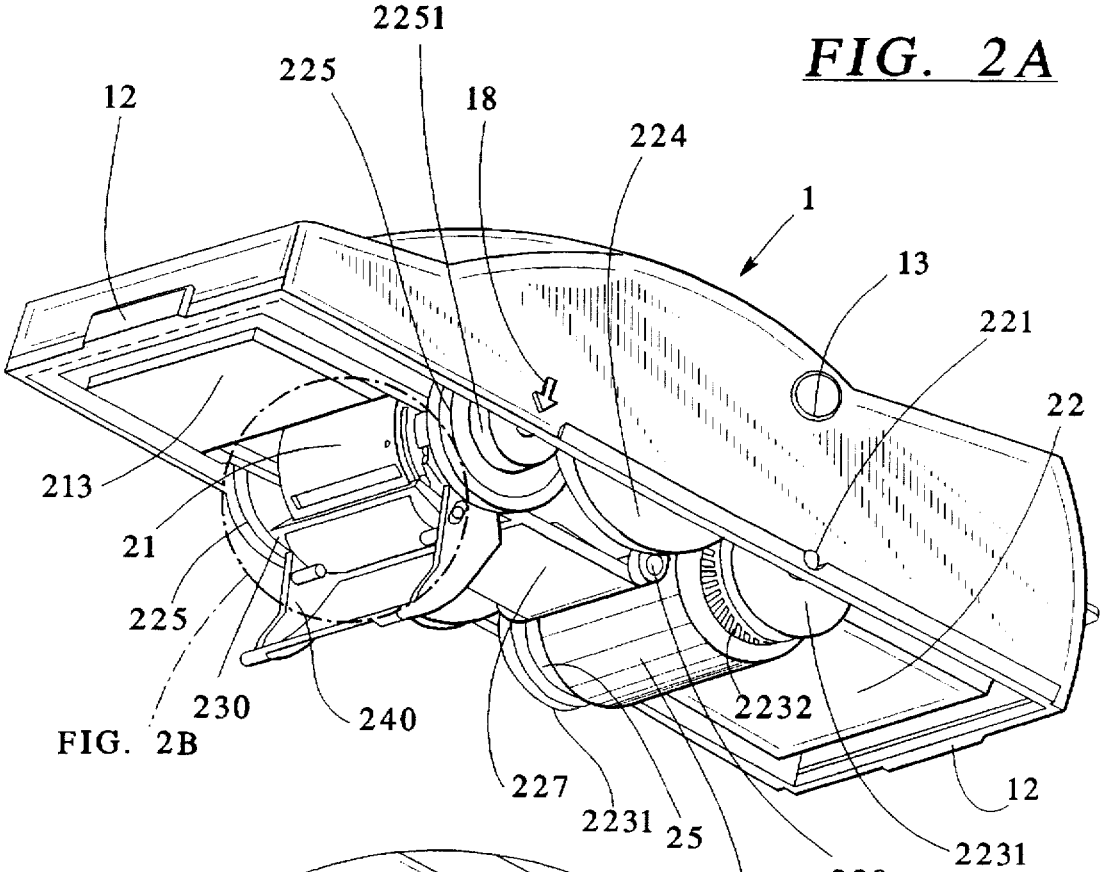
FIG. 2A is a perspective view of the manual franking machine constructed in accordance with the principles of the present invention from below with details of the sealing cap.
Figure 2B:
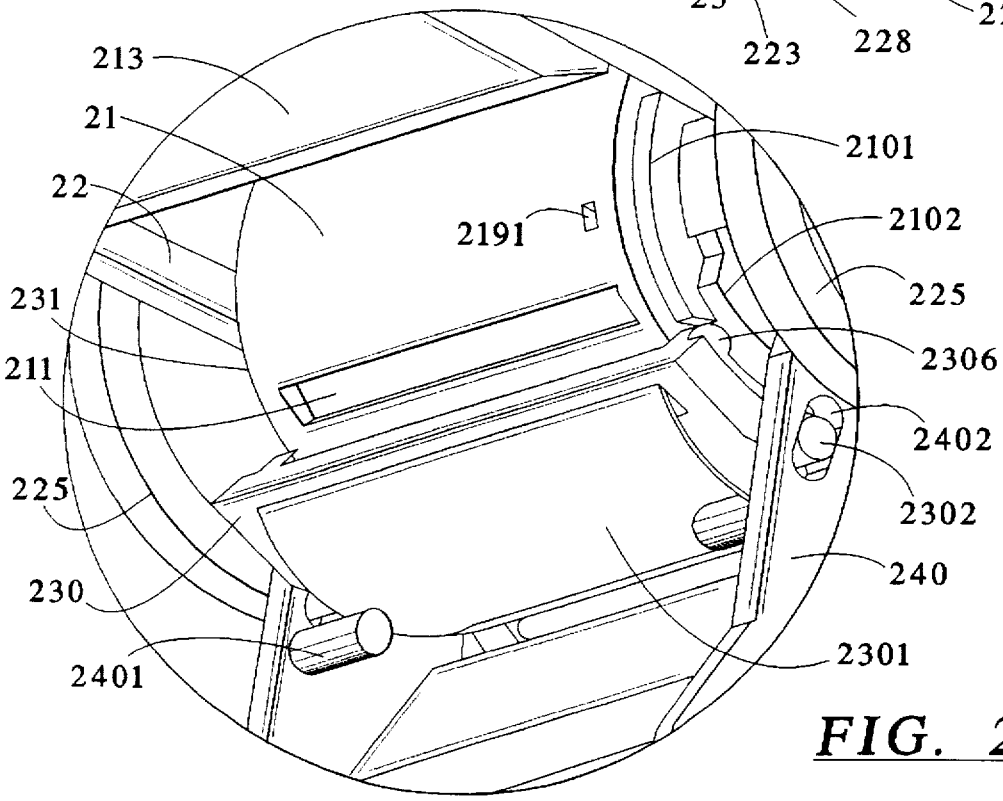
FIG. 2B is an enlarged detail of a portion of FIG. 2A.

As can be seen from the views of FIGS. 2A and 2B a sealing cap 230 is arranged pivotably against the drum 231 of the ink print head 21 with a lever 240 that is in turn secured to a lever 227. The lever 227 is pivotable around an axis 228 and is resiliently seated.

Figure 3:
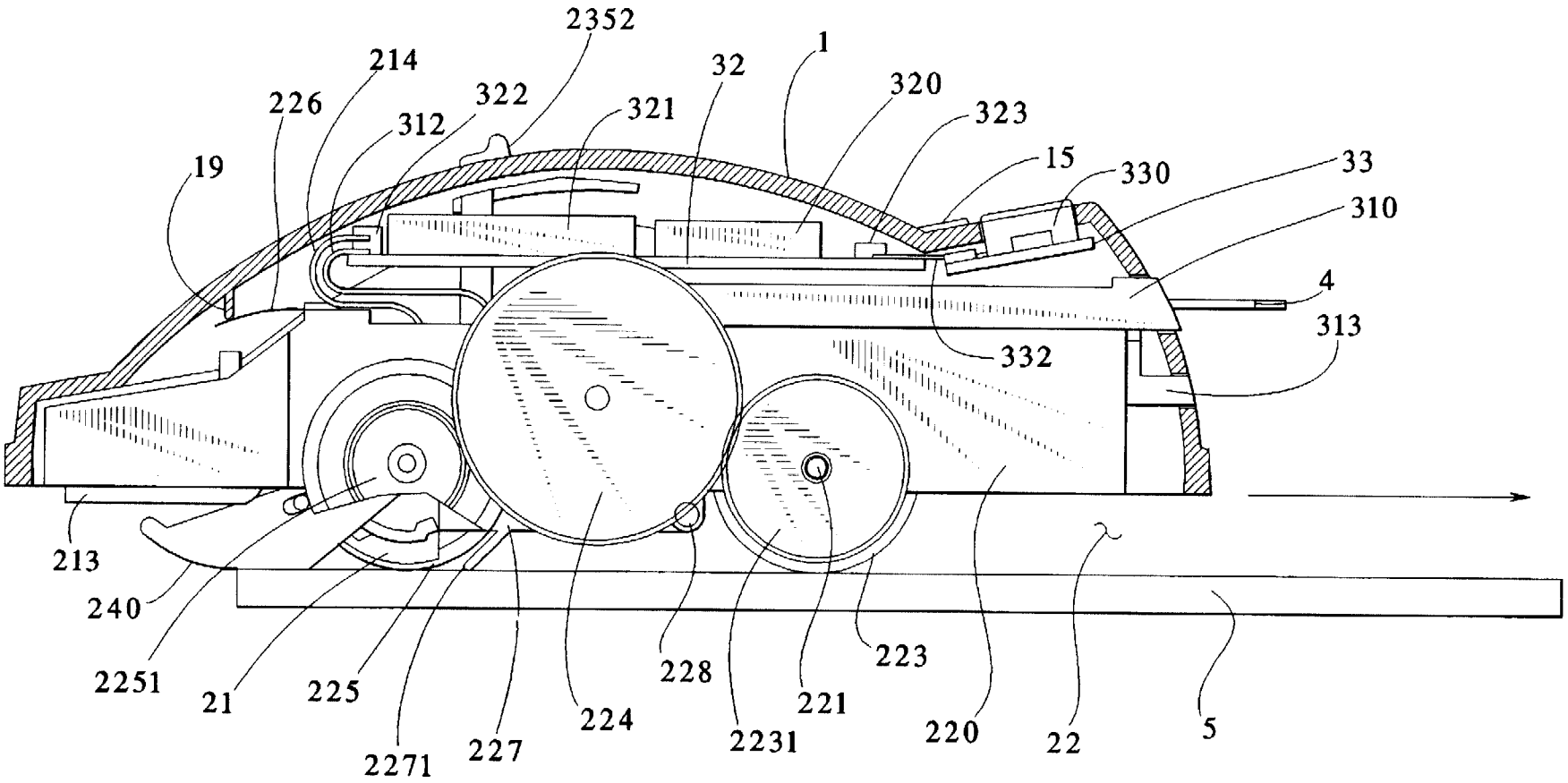
FIG. 3 is a longitudinal section with the section through the housing of the manual franking machine constructed in accordance with the principles of the present invention.
Figure 7:
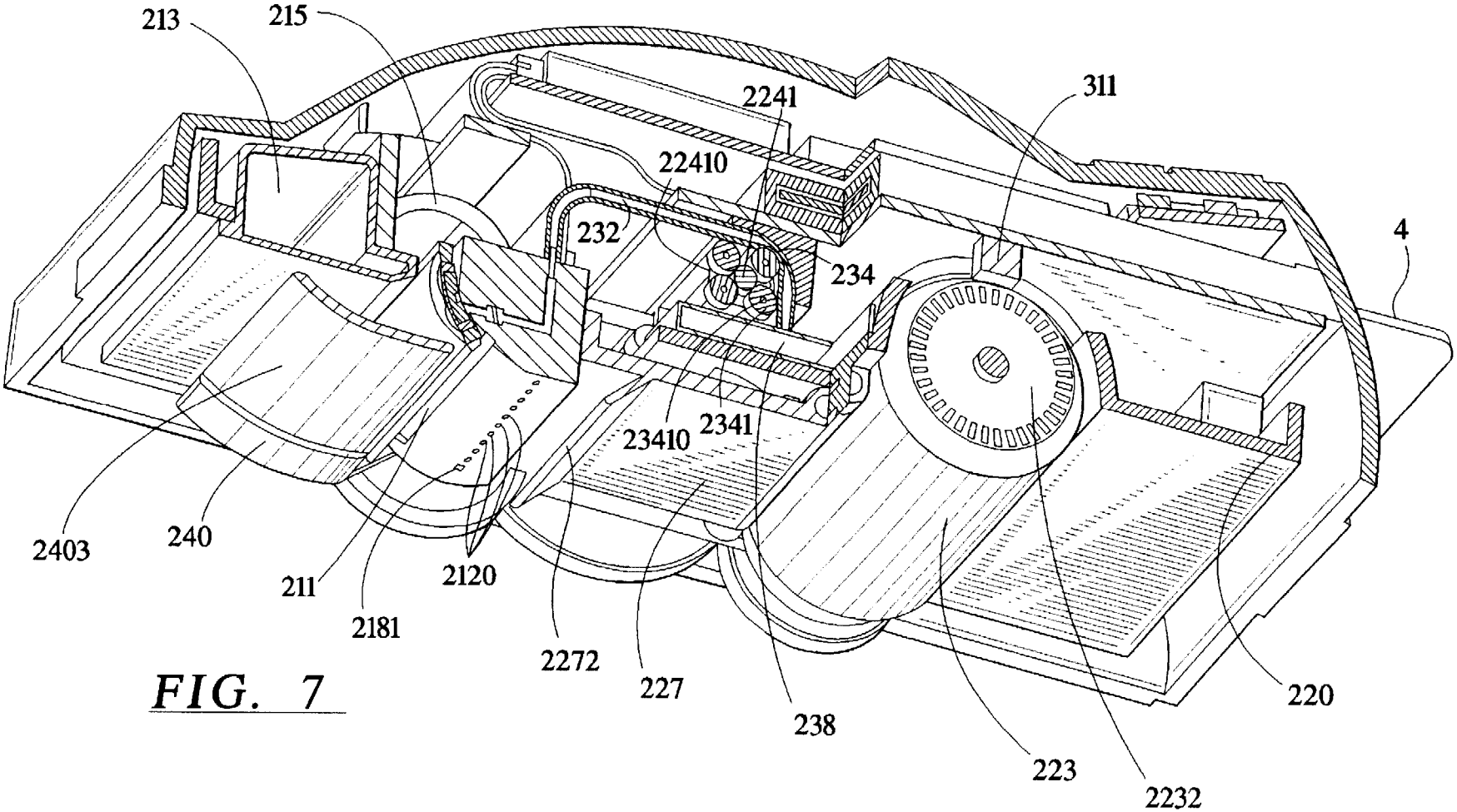
FIG. 7 is a perspective view of the manual franking machine constructed in accordance with the principles of the present invention from below given a longitudinal section in the region of the suction pump for automatic operation.

At its end facing toward the recording medium 5—also see FIG. 3 and FIG. 7—, the lever 240 has a central region 2403 disposed at a spacing above the imprint, and lies on the recording medium outside the imprint only via two outboard rockers and is elastic in this latter region. The lever 240 is prevented from sliding across the fresh imprint in this way but adapts to partial irregularities.

A spring 2301 is clamped between sealing cap 230 and lever 240 so that the sealing cap 230 lies against the ink printer head 21 in a friction-actuated manner. The spring 2301 engages into a correspondingly shaped recess (not referenced in detail) of the sealing cap 230, and also lies against two detents 2401 that are attached to the lever 240.

The lever 240 further has two oblong holes 2402 into which the sealing cap 230 is hooked with two pegs 2302. Outside at its edge, the sealing cap 230 has two first catch noses 2306 that lie against first guide strips 2101 at the housing 210 of the ink printer head 21. The sealing cap 230 has two catch noses 2307 lying against second guide strips 2102 at the housing; also see FIGS. 6 and 9 in this respect.

A channel 211 in the drum 231 serves as receptacle and stripper edge for a wiper lip 2303 secured to the sealing cap 230. A suction opening 2191 in the drum 231 leads via a second extraction channel 219 to the peristaltic suction pump 234 for automatic operation.

A front wheel 223 that is implemented as a drum-shaped friction wheel with an incremental sensor 2232 to which the sensor 311 is allocated is seated on the front shaft 221. The travel speed is thus acquired regardless of the quality of the recording medium 5, and the ink printer head 21 can be correspondingly controlled by the microprocessor 320.

The coupling of the drive wheels 2231 to the driven wheels 2251 via the two coupling wheels 224 is shown in FIG. 3. All wheels are expediently implemented as gear wheels, whereby the gear ratio of the drive wheels 2231 to the driven wheels 2251 is greater than one. The rear wheels 225 consequently turn somewhat faster than the front wheel 223; the result being that the recording medium 5 is pulled toward the back. In order to maintain the recording medium 5 is taut only in the printing region, the rear wheels 225 have a lower coefficient of friction at the outside circumference than the front wheel 223; one possibility is that they are smoother.

It may also be seen how a constant spacing of the ink print head 21 from the recording medium 5 is always maintained. To this end, a spacer nose 2271 that glides along the recording medium 5 given movement of the manual franking machine thereover is applied to the lever 227 that carries the ink printer head 21.

A detent 19 against which the spring 226 presses in a friction-actuated manner is applied to the housing 1, the spring 226 being attached to the carriage frame 220. In this way, the housing 1 is seated on the carriage 22 so as to be resiliently rotatable around the axis 221. A lock with a possible seal may be provided.

From the plug-type connector 322 on the second circuit board 32, the connecting cable 214 proceeds to the ink printer head 21 via a connector 2141 (see FIG. 9*a*) and the connecting cable 312 proceeds to the first circuit board 31.

Figure 4:
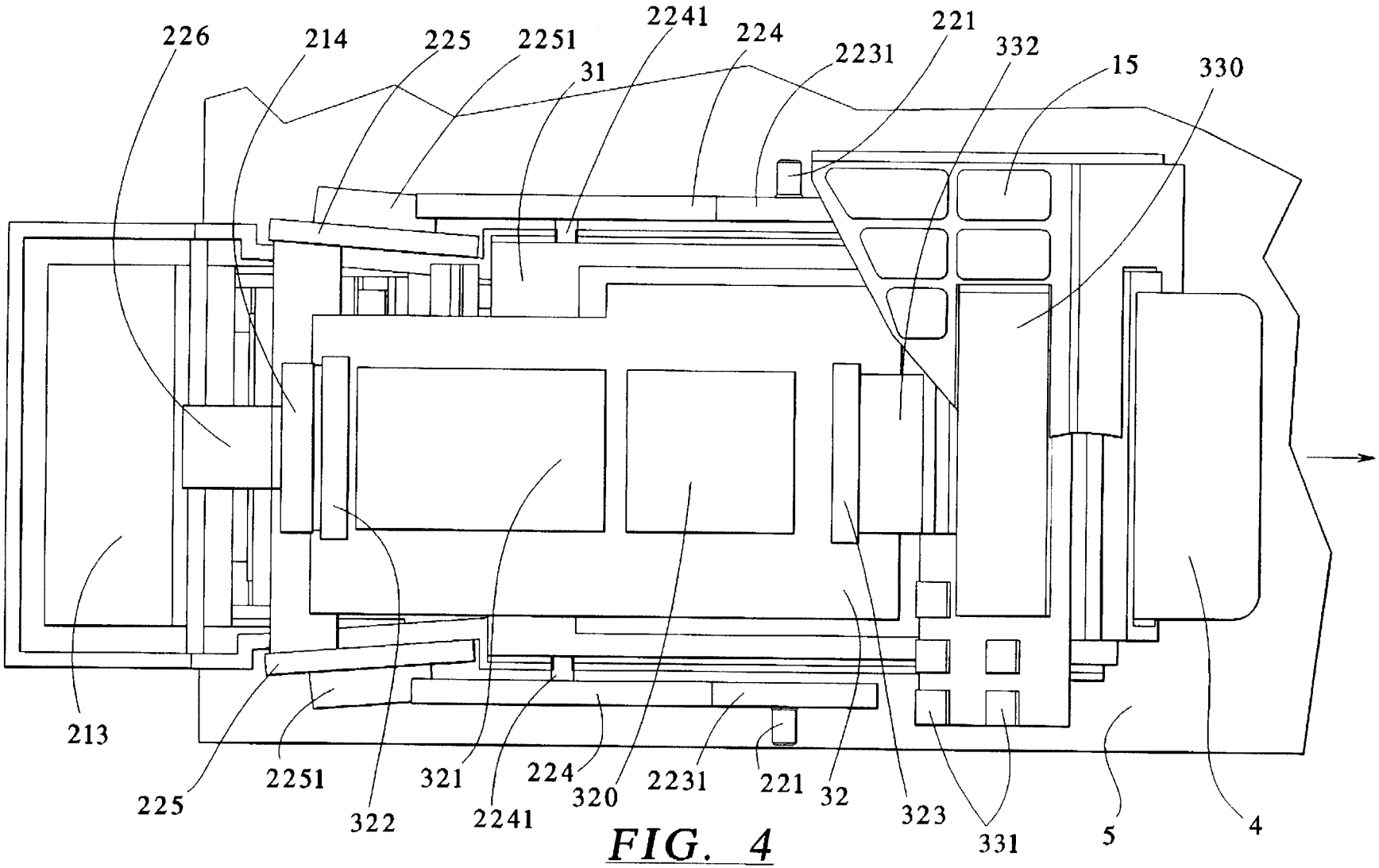
FIG. 4 is a plan view onto the carriage of the partly cutaway housing of the manual franking machine constructed in accordance with the principles of the present invention.

FIG. 4 shows that the rear wheels 225 are set inwardly in the traveling direction. The result is that the recording medium is also maintained taut in transverse direction when the manual franking machine moves thereover.

Figure 5:
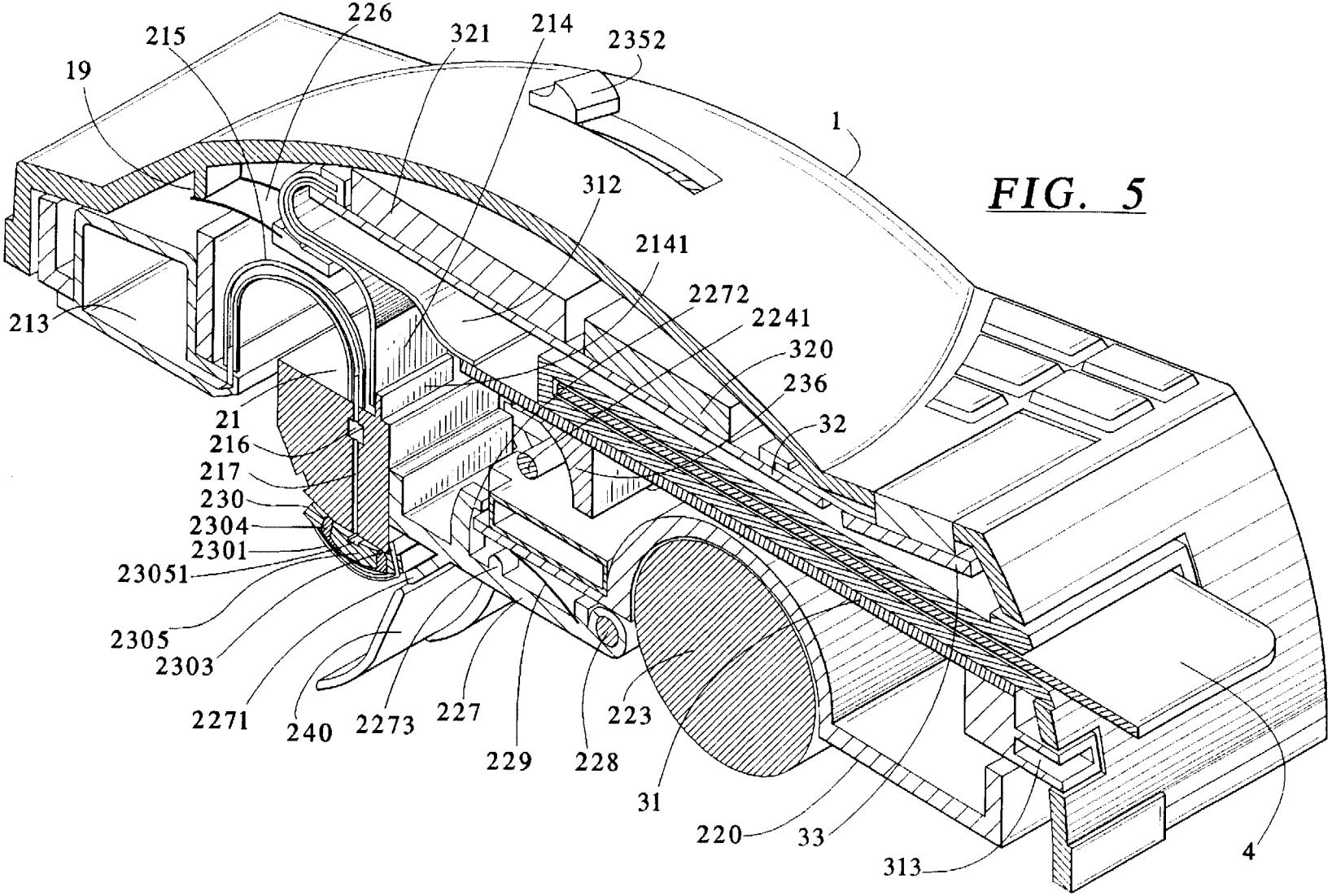
FIG. 5 is a perspective view onto a longitudinal section in the region of the ink delivery channel in the manual franking machine constructed in accordance with the principles of the present invention.

FIG. 5 shows how the ink printer head is rotatably resiliently seated so that a distance compensation to the recording medium is always possible. The lever 227 which is pivotable around the shaft 228 has a stop nose 2272 and a stop nose 2273. The stop nose 2272 is hook-shaped and engages behind an edge of the carriage frame 220. The stop nose 2273 is directed toward the base of the carriage frame 220. A spring 229 is secured to the lever 227 in the proximity of the pivot point thereof and lies non-positively (unattached) against the base of the carriage frame 220. As a result thereof, the stop nose 2272 comes to be seated against the aforementioned edge of the carriage frame 220. The stop nose 2273 is then at its maximum distance from the base of the carriage frame 220. The maximum range of swivel for the ink printer head 21 is defined by this distance at the same time, corresponding to the lever spacing. When the manual franking machine is put in place on the recording medium 5, the stop nose 2271 presses the lever 227 opposite the action of the spring 229. The limit position is when the stop nose 2273 lies against the carriage frame.

The connection from the ink tank 213 via the ink hose 215 to the delivery channel 216 and to an ink channel 217 of the ink printer head 21 may also be seen in the sectional view. The ink pressure chambers have been omitted for clarity.

Figure 9A:
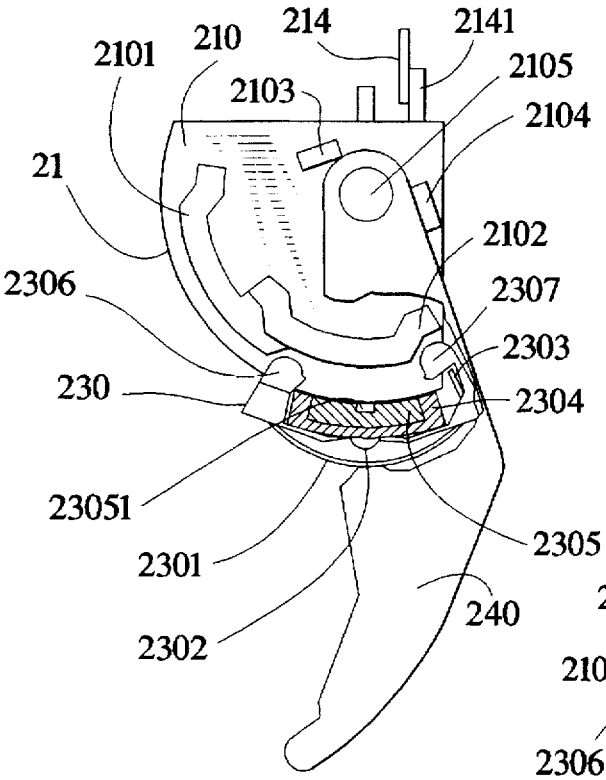
FIGS. 9A, 9B, and 9C are cross-sections through the sealing cap and details regarding the sealing cap guide in the manual franking machine constructed in accordance with the principles of the present invention.

In the illustrated case, the sealing cap 230 is pivoted in front of the nozzle apertures 2120; also see FIGS. 7 and 9*a* with respect thereto. Ink that is sprayed out proceeds into a channel 23051 of a suction pad 2305 that is arranged within a seal 2304 of the sealing cap 230. Due to the action of the spring 2301, the seal 2304 of the sealing cap 230 lies against the nozzle surface of the ink printer head 21 in a spring-actuated manner; the space in front of the nozzle row 2120 is free due to the channel 23051. When the sealing cap 230 is pivoted away, the suction pad 2305 relaxes and the storage volume is thus increased, dripping again being avoided. When the sealing cap 230 is pivoted, moreover, a wiper lip 2303 secured thereto is operated.

The connection 2141 at the ink printer head 21 for the connecting cable 214, the shaft 2241 for the coupling wheels 224 as well as the pump housing 236 can also be seen in the sectional view.

The views in FIGS. 6B, 6C, and 6D show details of the peristaltic suction pump 235 for manual operation, of a centrifugal brake 25 as well as further details of the ink printer head 21, respectively, from the overall view of the assembly shown in FIG. 6A.

The peristaltic suction pump 235 is actuatable when the sealing cap 230 is pivoted in front of the nozzle surface of the ink printer head 21. The peristaltic suction pump 235 has four rollers 2351 that are respectively rotatably seated on shafts 2371 and form an assembly seated rotatably around the shaft 2241 for the coupling wheels 224. The second hose 233 from the cleaning part 231 to the extraction tank 238 is conducted between the rollers 2351 and the housing wall of the pump housing 236. Upon rotation of the roller assembly in a clockwise direction, the hose 233 is successively compressed in the direction toward the extraction tank 238, so that ink that has been suctioned proceeds into the extraction tank 238.

The centrifugal brake 25 is seated on the front axle 221 and is constructed in a known way. The housing 251 is formed into the carriage 220. The centrifugal brake 25 is composed of a first brake shoe 252 seated on an axle 253 together with an associated detent 258, a second brake shoe 255 seated on an axle 256 together with an associated detent 259, as well as two compression springs 254, 257. A compression spring 254 is arranged between the detent 259 and a leg of the brake shoe 252, so that the other leg of the brake shoe 252 is pressed against the detent 258 by the spring power. Analogously, a compression spring 257 is arranged between the detent 258 and a leg of the brake shoe 255, so that the other leg of the brake shoe 255 is pressed against the detent 259. If an allowed, maximum speed is exceeded, the centrifugal forces acting on the brake shoes 252, 255 become greater than the spring powers, causing the brake shoes 252 and 255 to press against the wall of the housing 251 and thus braking the manual franking machine.

The sectional view of the ink printer head 21 reveals the manner of ink delivery via the connection 2108 for the ink hose 215 from the ink tank 213. The ink first flows into the delivery channel 216 and from the latter to the nozzle apertures 212 via the ink channels 217. The ink ejected for cleaning purposes during the extraction procedure with manual operation is conducted via the extraction opening 2181 into the extraction channel 218 to the connection 2107 for the second hose via the peristaltic suction pump 235 to the extraction tank 238. The valve 2182 in the extraction channel 218 is opened when the sealing cap 230 is pivoted in front of the nozzles apertures 212 and the extraction opening 2181. When the sealing cap 230 has been pivoted into the second limit position, then the valve 2182 is closed and the valve in the extraction channel 219 is opened. As can also be seen in FIG. 7, the residual ink is sucked out of the sealing cap 230 via the extraction opening 2191, the connection 2106, the first hose 232 via the peristaltic suction pump 234 into the extraction tank 238.

For defined guidance and positioning of the sealing cap 230, the sidewalls of the ink printer head 21 are provided with a first guide strip 2101, a second guide strip 2102, an upper stop 2103 and a lower stop 2104 as well as with a peg 2105 for suspending the lever 240 for the sealing cap 230. The upper stop 2103 and the guide strip 2101 assure the proper positioning of the sealing cap 230 during automatic extraction or during printing mode. The lower stop 2104 and the guide strip 2102 assure the proper positioning of the sealing cap 230 during manual extraction mode, or given standstill of the manual franking machine with print deactivation.

Figure 8:
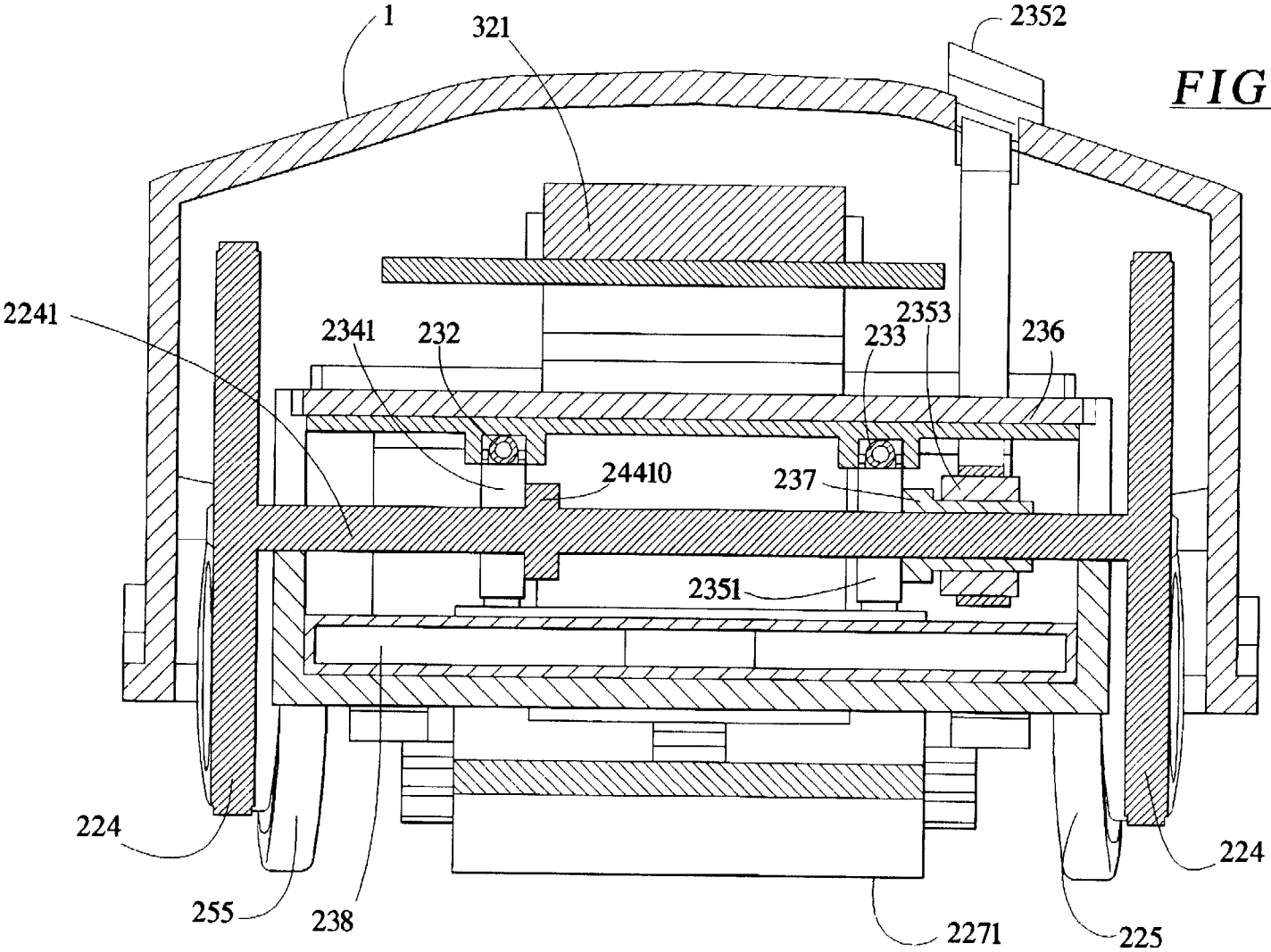
FIG. 8 is a cross-section through the manual franking machine constructed in accordance with the principles of the present invention in the region of the shaft for the coupling wheels.

As shown in FIG. 7, the peristaltic suction pump 234 for automatic operation is also composed of four rollers 2341 with axles 23410 that are secured in an axle bearing 22410 that is in turn rigidly connected to the axle 2241; also see FIG. 8. Upon rotation of the axle 2241—triggered by the motion of the manual franking machine—, the axle bearing 22410 is turned with the axle 2241, and thus the rollers 2341 are rotated as an assembly resulting in the first hose 232 being successively compressed in the direction of the extraction tank 238.

FIG. 7 also shows the arrangement of the sensor 311 for the incremental sensor 2232 that is implemented as an integral component of the front wheel 223. The sensing grid of the incremental sensor 2232 is as finely subdivided as required by the drive for the ink printer head 21 so that printing and transport speed can be matched to one another.

FIG. 8, a view toward the back part of the manual franking machine, shows the slanted positioning of the r ear wheels 225 and further shows the attachment of the peristaltic suction pump 235 on the axle 2241. The operating lever 2352 engages, via an overriding clutch 2353, into the drive sleeve 237 in which the axle 2371 (see FIG. 6) for the rollers 2351 is secured. By moving the lever 2352, the drive sleeve 237 is rotatable in the direction of the hose 233 to the extraction tank 238 via the overriding clutch 2353, and thus the assembly of rollers 2351 is rotated as well.

FIG. 9 shows the structure of the sealing cap 230 as well as the possible positions thereof at the ink printer head 21.

The sealing cap 230 contains a suction pad 2305 with a channel 23051. The suction pad 2305 is surrounded by a seal 2304 that, when put in place, non-positively lies against the ink printer head 21 with the pressure of the spring 2301.

In FIG. 9A, the sealing cap 230 is in the lower limit position for cleaning with a manual operation, into which the sealing cap 230 is pressed by a spring (not shown in detail). The lever 240 lies against the lower stop 2104 of the housing 210 of the ink printer head 21, and the second catch nose 2307 of the sealing cap 230 engages into the outer lowering of the second guide strip 2102 and the seal 2304 lies non-positively against the ink printer head 21.

Figure 9B:
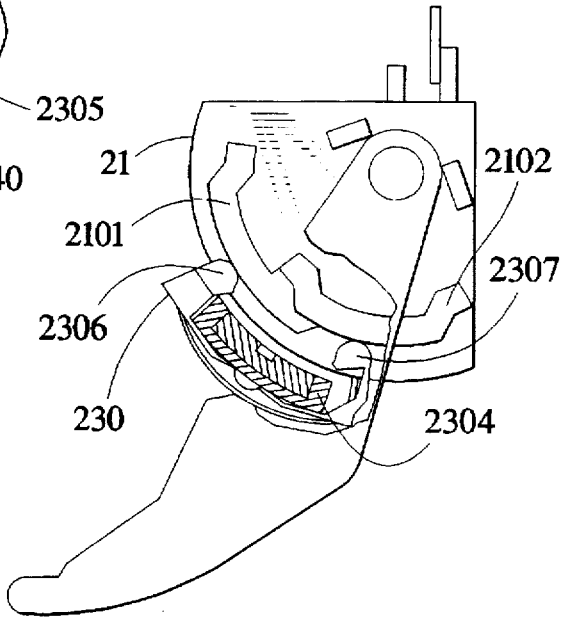

In FIG. 9B, the sealing cap assumes a transitional position in which no cleaning occurs. The first catch nose 2306 of the sealing cap 230 lies on the first guide strip 2101 and the second catch nose 2307 lies on the second guide strip 2102. The seal 2304 is thereby lifted off from the ink printer head 21.

Figure 9C:
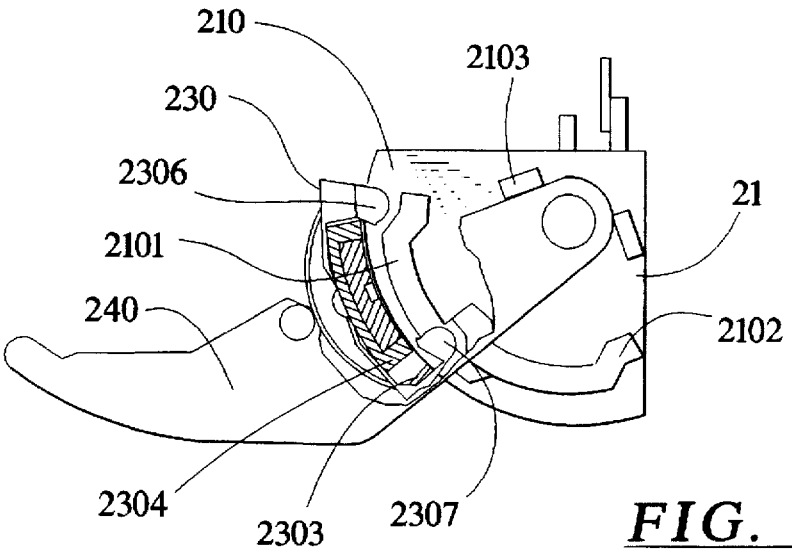

In FIG. 9C, the sealing cap 230 is in the upper limit position for extraction with automatic operation. The lever 240 lies against the upper stop 2103 of the housing 21 0, and the first catch nose 2306 of the sealing cap 230 engages into the outer lower portion of the first guide strip 2101 and the second catch nose 2307 engages into the inner lower portion of the second guide strip 2102. The seal 2304 of the sealing cap 230 again lies non-positively against the ink printer head 21.

During the motion between the limit positions, the wiper lip 2303 glides across the nozzle surface of the ink printer head 21 like a doctor and implements a rough cleaning.

Figure 10:
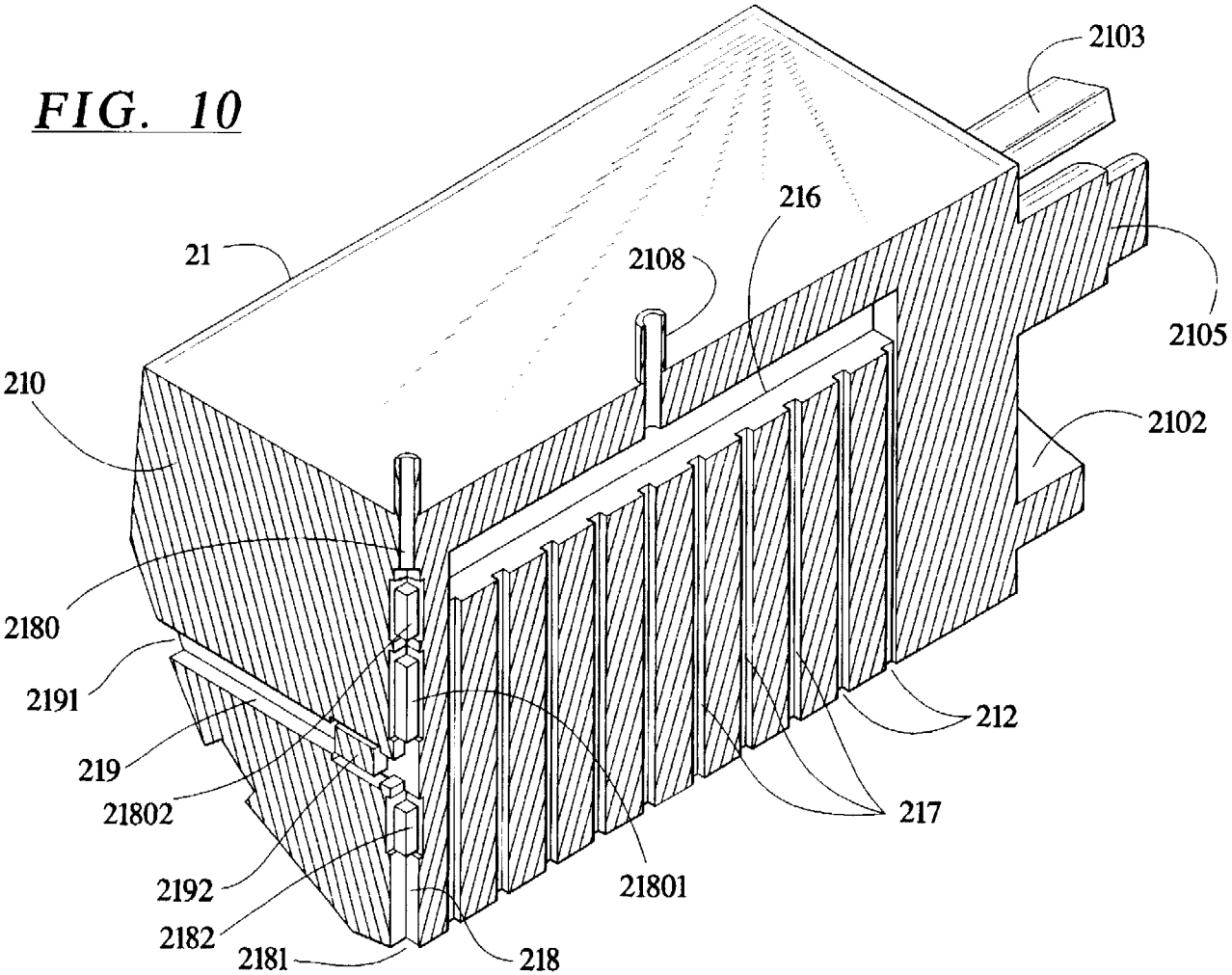
FIG. 10 is a perspective view of an angular section through an ink printer head with micro-structure pump in the manual franking machine constructed in accordance with the principles of the present invention.
Figure 11:
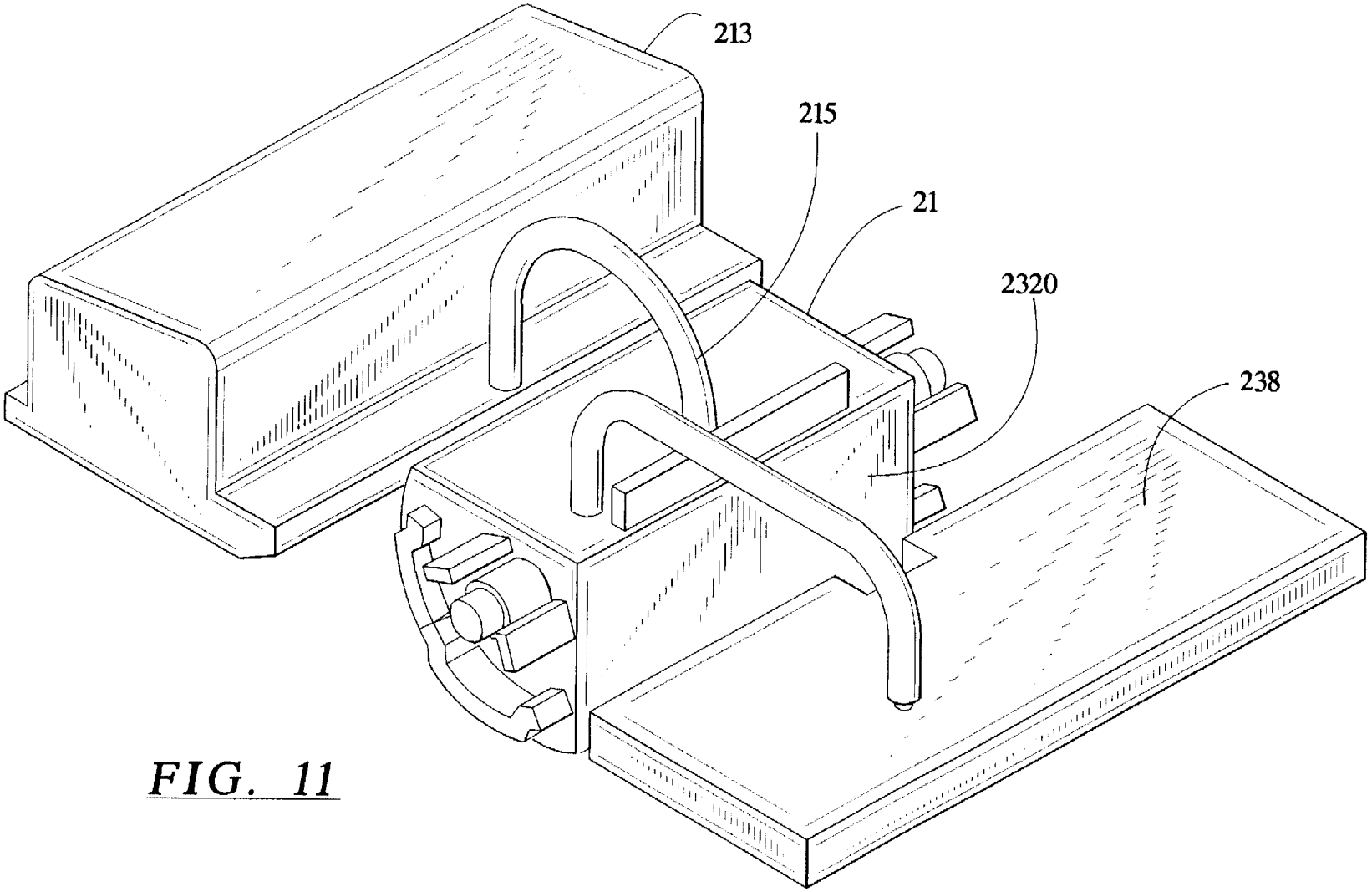
FIG. 11 is a perspective view of an ink printer head according to FIG. 10 and the associated ink tank and extraction tank.

FIG. 10 shows an angular section through an ink printer head 21 with an integrated micro-structure pump 21801 in a common extraction channel 2180. Whereas the relationships of the ink delivery, ink line and of the ink ejection are unmodified, the orthogonal extraction channels 218 and 219 are arranged so as to converge in the common extraction channel 2180, but are alternately connected to the micro-structure pump 21801, or are opened or closed via their allocated valves 2181 and 2192. Only one hose 2320 leads to the extraction tank 238 from the common extraction channel 2180; also see FIG. 11. The extraction channel 2180 downstream of the micro-structure pump 21801 can be closed or opened as needed via a valve 21802 therein.

The two peristaltic suction pumps, including their drive, are eliminated in this embodiment of the manual franking machine with an ink printer head 21 with integrated micro-structure suction pump 21802. The power for the operation of the micro-structure suction pump 21801 is drawn from the battery.

Although modifications and changes may be suggested by those skilled in the art, it is the intention of the inventor to embody within the patent warranted hereon all changes and modifications as reasonably and properly come within the scope of his contribution to the art.

I claim as my invention:

1. An electronic manual postage meter machine comprising:

a housing;

a first assembly in said housing including an ink printer head having nozzles connected to a replaceable ink tank and cleaning means actuatable for cleaning ink from said nozzles, said cleaning means having a sealing cap and means for moving said sealing cap upon actuation of said cleaning means for enclosing said nozzles with said sealing cap during cleaning of said nozzles, and a carriage on which said ink printer head and said ink tank and said cleaning part are mounted for moving said ink printer head over a medium onto which an ink imprint is to be printed; and a second assembly in said housing containing at least one data entry means for recrediting postage values electronic control means connected to said means for recrediting and to said ink printer head for controlling said ink printer head to produce said imprint, and a battery connected to said control means.

2. An electronic manual postage meter machine as claimed in claim 1 wherein said at least one first wheel comprises a drum, and wherein said second assembly includes an incremental sensor means, connected to said control means, for sensing rotation of said drum as said drum moves over said medium.

3. An electronic manual postage meter machine as claimed in claim 1 wherein said ink printer head comprises a plurality of ink nozzles, and said electronic manual postage meter machine further comprising cleaning means for cleaning ink from said nozzles combined with said ink printer head as an integrated component.

4. An electronic manual postage meter machine as claimed in claim 1 wherein said control means comprise a microprocessor.

5. An electronic manual postage meter machine as claimed in claim 1 wherein said battery comprises a rechargeable battery, and further comprising a charging terminal for said rechargeable battery.

6. An electronic manual postage meter machine as claimed in claim 1 wherein said ink printer head comprises a plurality of ink nozzles, and said electronic manual postage meter machine further comprising cleaning means for cleaning ink from said nozzles, said cleaning means being a separate component from said ink printer head and rigidly connected to said ink printer head.

7. An electronic manual postage meter machine as claimed in claim 6 wherein said ink printer head has a printer head housing, and wherein said cleaning means is attached to said printer head housing.

8. An electronic manual postage meter machine as claimed in claim 1 wherein said data input means comprise a write/read unit for a postage value credit card.

9. An electronic manual postage meter machine as claimed in claim 8 wherein said control means comprise a microprocessor.

10. An electronic manual postage meter machine as claimed in claim 9 further comprising electrical conductor means respectively connecting said microprocessor to said read/write unit and electrical conductor means connecting said microprocessor to said ink printer head.

11. An electronic manual postage meter machine as claimed in claim 1 wherein said cleaning means comprises:

said sealing cap;

said means for moving said sealing cap, comprising means for mounting said sealing cap on said carriage for moving said sealing cap into sealed relation with said ink printer head for producing a sealed volume over said nozzles;

a first extraction channel having a one-way valve therein opening into said sealed volume;

a second extraction channel having one-way valve therein opening into said sealed volume, said first and second extraction channels being disposed offset relative to each other in said sealed volume;

a common extraction channel connected to both said first and second extraction channels;

a microstructured suction pump and a one-way valve disposed in said common extraction channel, said common extraction channel being connected to said extraction tank and said microstructured pump being operable to drawing ink from said nozzles in alternation through one of said first or second extraction channels dependent on a position of said sealing cap producing said sealed volume over said nozzles and said first extraction channel or producing said sealed volume over said nozzles and said second extraction channel.

12. An electronic manual postage meter machine as claimed in claim 11 wherein said means for mounting said seal cap on said carriage comprise a lever, carrying said sealing cap, for pivoting said sealing cap against said ink printer head for alternately producing said sealed volume over said nozzles and said first extraction channel and over said nozzles and said second extraction channel.

13. An electronic manual postage meter machine as claimed in claim 12 wherein said sealing cap comprises a wiper lip, a replaceable suction pad, and an elastic seal surrounding said sealing cap.

14. An electronic manual postage meter machine as claimed in claim 13 wherein said sealing cap further comprises a channel for said wiper lip in which said wiper lip is received and comprising a stripper edge during cleaning and forming a receptacle during printing.

15. An electronic manual postage meter machine as claimed in claim 12 wherein said means for mounting said sealing cap on said frame comprise:

first and second catches carried on opposite sides at an exterior of said sealing cap;

first and second guide elements mounted on said ink printer head along which said first and second catches respectively glide, each guide element having a recess therein into which said first and second catches move as said first and second catches glide along said guide elements for moving said sealing cap into said sealed relation with said ink printer head; and an ink printer head housing having a first upper stop and a first lower stop at one side thereof and having a second upper stop and a second lower stop at an opposite side thereof said first and second upper stops stopping said sealing cap to produce said sealed volume over said nozzles and said first extraction channel and said first and second lower stops stopping said sealing cap to produce said sealed environment over said nozzles and said second extraction channel.

16. An electronic manual postage meter machine as claimed in claim 15 further comprising spring means for pressing said first and second catches against said first and second guide elements, and wherein said sealing cap has first and second pegs on opposite sides thereof and wherein said lever has first and second oblong holes respectively pivotably receiving said first and second pegs.

17. An electronic manual postage meter machine as claimed in claim 1 wherein said carriage comprises a rigid carriage frame having a front axle rotationally seated therein and at least one rear axle mounted therein, at least one first wheel mounted on said front axle and a second pair of wheels mounted on said rear axle, said electronic manual postage meter machine further comprising means for resiliently mounting said carriage frame and said front axle in said housing for permitting pivoting of said carriage frame and said front axle relative to said housing, and wherein said first assembly further includes a lever on which said ink printer head is mounted, and a lever axle mounted in said carriage frame and attached to said lever for permitting pivoting of said lever around said lever axle.

18. An electronic manual postage meter machine as claimed in claim 17 wherein said pair of second wheels are inwardly canted in a direction of travel of said ink printer head relative to said medium.

19. An electronic manual postage meter machine as claimed in claim 17 further comprising a centrifugal brake having a centrifugal brake mounted on said front axle and having a brake housing, comprising a brake cylinder, which is rigidly mounted to said carriage frame.

20. An electronic manual postage meter machine as claimed in claim 17 wherein said means for resiliently mounting comprises a stop element in said housing a spring secured to said carriage frame pressing under tension against said stop element.

21. An electronic manual postage meter machine as claimed in claim 17 wherein said ink printer head comprises a plurality of ink nozzles, and further comprising a spring attached to said lever, said spring pressing under tension against said carriage frame, two stop elements carried on said lever for limiting a pivoting range of said lever, and a spacer attached to said lever for maintaining a substantially constant spacing between said ink nozzles and said medium.

22. An electronic manual postage meter machine as claimed in claim 17 wherein said first assembly includes drive wheels mounted on said front axle on opposite sides of said at least one first wheel for co-rotation with said at least one first wheel, a pair of driven wheels mounted on said rear axle for co-rotation with said pair of second wheels, and coupling means engaging said drive wheels and said driven wheels for driving said driven wheels relative to said drive wheels with a drive ratio greater than 1.

23. An electronic manual postage meter machine as claimed in claim 22 wherein said pair of second wheels have an outer circumference with a first coefficient of friction and wherein said at least one front wheel has an outer circumference with a second coefficient of friction, said first coefficient of friction being lower than said second coefficient of friction.

24. An electronic manual postage meter machine as claimed in claim 22 wherein said drive wheels are integral with said at least one first wheel, and wherein said driven wheels are integral with said pair of second wheels.

25. An electronic manual postage meter machine as claimed in claim 22 wherein said coupling means comprises coupling wheels, and wherein each of said drive wheels, said coupling wheels, and said driven wheels comprise a gear wheel.

26. An electronic manual postage meter machine as claimed in claim 22 wherein said coupling means comprises an axle rotationally mounted in said carriage frame, and coupling wheels rigidly mounted on said axle.

27. An electronic manual postage meter machine as claimed in claim 26 wherein said cleaning means comprises:

said sealing cap;

said means for moving said sealing cap, comprising means for mounting said sealing cap on said carriage for moving said sealing cap into sealing relation with said ink printer head for producing a sealed volume over said nozzles;

first and second extraction channels communicating with said sealed volume and disposed offset relative to each other in said sealed volume, each of said first and second extraction channels having a one-way valve therein;

a first peristaltic suction pump in communication with said first extraction channel and a second peristaltic suction pump in communication with said second extraction channel, each of said first and second suction pumps being in communication with said extraction tank; and manually operable clutch means, actuated by a manually operable lever, for engaging said first and second peristaltic suction pumps, in alternation dependent on a position of said sealing cap, with said coupling wheels for operating said first and second peristaltic suction pumps to extract ink from said sealed volume into said extraction tank as said coupling wheels are rotated as said at least one first wheel moves over said medium.

28. An electronic manual postage meter machine as claimed in claim 27 wherein said means for mounting said seal cap on said carriage comprise a lever, carrying said sealing cap, for pivoting said sealing cap against said ink printer head for alternately producing said sealed volume over said nozzles and said first extraction channel and over said nozzles and said second extraction channel.

29. An electronic manual postage meter machine as claimed in claim 28 wherein said sealing cap comprises a wiper lip, a replaceable suction pad, and an elastic seal surrounding said sealing cap.

30. An electronic manual postage meter machine as claimed in claim 29 wherein said sealing cap further comprises a channel for said wiper lip in which said wiper lip is received and comprising a stripper edge during cleaning and forming a receptacle during printing.

31. An electronic manual postage meter machine as claimed in claim 28 wherein said means for mounting said sealing cap on said frame comprise:

first and second catches carried on opposite sides at an exterior of said sealing cap;

first and second guide elements mounted on said ink printer head along which said first and second catches respectively glide, each guide element having a recess therein into which said first and second catches move as said first and second catches glide along said guide elements for moving said sealing cap into said sealed relation with said ink printer head; and an ink printer head housing having a first upper stop and a first lower stop at one side thereof and having a second upper stop and a second lower stop at an opposite side thereof said first and second upper stops stopping said sealing cap to produce said sealed volume over said nozzles and said first extraction channel and said first and second lower stops stopping said sealing cap to produce said sealed environment over said nozzles and said second extraction channel.

32. An electronic manual postage meter machine as claimed in claim 31 further comprising spring means for pressing said first and second catches against said first and second guide elements, and wherein said sealing cap has first and second pegs on opposite sides thereof and wherein said lever has first and second oblong holes respectively pivotably receiving said first and second pegs.

33. An electronic manual postage meter machine comprising:

a housing;

ink printer head means in said housing for producing an imprint on a medium, said ink printer head means including nozzles through which ink is ejected onto said medium;

means in said housing for moving said ink printing head means over said medium by moving said housing relative to said medium;

actuatable cleaning means, disposed in said housing, for, upon actuation, moving into sealing engagement with said ink printer head means for cleaning ink from said nozzles:

electronic control means in said housing, connected to said ink printer head means, for controlling operation of said ink printer head means; and a battery in said housing, connected to said electronic control means, for supplying power to said electronic control means.

* * * * *